US011095974B1

(12) United States Patent
Wheeler

(10) Patent No.: US 11,095,974 B1
(45) Date of Patent: Aug. 17, 2021

(54) EXTERNAL NOISE CONTROL FOR A LOUDSPEAKER

(71) Applicant: Harman International Industries, Incorporated, Stamford, CT (US)

(72) Inventor: Brandon Michael Wheeler, Livonia, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/790,091

(22) Filed: Feb. 13, 2020

(51) Int. Cl.

| | |
|---|---|
| ***H04R 1/28*** | (2006.01) |
| ***H04R 1/02*** | (2006.01) |
| ***H04R 7/12*** | (2006.01) |
| ***H04R 9/06*** | (2006.01) |

(52) U.S. Cl.
CPC ..... *H04R 1/288* (2013.01); *H04R 1/025* (2013.01); *H04R 7/12* (2013.01); *H04R 9/06* (2013.01); *H04R 2307/021* (2013.01); *H04R 2307/025* (2013.01); *H04R 2307/029* (2013.01); *H04R 2400/11* (2013.01); *H04R 2499/13* (2013.01)

(58) Field of Classification Search
CPC ..... H04R 1/025; H04R 2400/11; H04R 2307/029; H04R 2499/13; H04R 9/06; H04R 7/12; H04R 1/288
USPC ..... 381/86, 302, 87, 332
See application file for complete search history.

(56) References Cited

U.S. PATENT DOCUMENTS

| | | | | |
|---|---|---|---|---|
| 5,731,551 | A | 3/1998 | Petrucci | |
| 5,964,491 | A | 10/1999 | Marsh et al. | |
| 5,996,727 | A * | 12/1999 | Blind | B60R 11/0217 181/141 |
| 6,195,442 | B1 * | 2/2001 | Griffin | H04R 1/2811 381/353 |
| 9,315,159 | B2 * | 4/2016 | Muller | H04R 1/02 |
| 9,866,933 | B2 | 1/2018 | Fincham | |
| 2009/0050402 | A1 | 2/2009 | Shinohara et al. | |
| 2009/0301809 | A1 * | 12/2009 | Aurenz | B60R 13/0815 181/290 |
| 2016/0373862 | A1 * | 12/2016 | Yoon | H04R 9/06 |
| 2019/0075392 | A1 * | 3/2019 | Kinoshita | H04R 1/2834 |
| 2019/0368244 | A1 * | 12/2019 | Wang | H04R 1/025 |

FOREIGN PATENT DOCUMENTS

| | | | | |
|---|---|---|---|---|
| CN | 105959833 | * | 2/2019 | H04R 3/00 |

* cited by examiner

*Primary Examiner* — Disler Paul
(74) *Attorney, Agent, or Firm* — Brooks Kushman P.C.

(57) ABSTRACT

In at least one embodiment, a loudspeaker assembly for a vehicle is provided. The assembly includes a diaphragm; a loudspeaker, and a carrier. The loudspeaker includes a first end for being positioned in a first area of the vehicle that is exposed to external ambient noise to the vehicle and a second end for being positioned in a second area of the vehicle that is exposed directly within an interior cabin of the vehicle to provide desired audio along a first axis to the interior cabin. The carrier is attached to the second end of the loudspeaker and includes noise absorption material to prevent the external ambient noise from entering into the vehicle. The carrier defines a plurality of openings positioned on an outer perimeter thereof to enable the desired audio to enter into the interior cabin along a second axis that is different than the first axis.

20 Claims, 4 Drawing Sheets

EXTERNAL NOISE CONTROL FOR A LOUDSPEAKER

TECHNICAL FIELD

Aspects disclosed herein generally relate to an external noise control apparatus for a loudspeaker. Specifically, the disclosed external noise control apparatus for the loudspeaker may be implemented in a vehicle. These aspects and others will be discussed in more detail below.

BACKGROUND

U.S. Pat. No. 5,996,727 to Blind et al. discloses a noise absorbing cover for an automotive loudspeaker to prevent exterior noise from being coupled through a loudspeaker to the interior of the automobile. An air gap is provided around the cover to provide a vent to static pressure for the loudspeaker, thereby avoiding any degradation in low frequency performance. The air gap is oriented to exclude direct sound transmission paths for exteriorly generated noise to the interior.

SUMMARY

In at least one embodiment, a loudspeaker assembly for a vehicle is provided. The assembly includes a diaphragm; a loudspeaker, and a carrier. The loudspeaker includes a first end for being positioned in a first area of the vehicle that is exposed to external ambient noise to the vehicle and a second end for being positioned in a second area of the vehicle that is exposed directly within an interior cabin of the vehicle to provide desired audio along a first axis to the interior cabin. The carrier is attached to the second end of the loudspeaker and to the diaphragm and includes noise absorption material to prevent the external ambient noise from entering into the interior of the cabin along the first axis. The carrier defines a plurality of openings positioned on an outer perimeter thereof to enable the desired audio to enter into the interior cabin along a second axis that is different than the first axis.

In at least another embodiment, a loudspeaker assembly for a vehicle is provided. The assembly includes a diaphragm; a loudspeaker, and a carrier. The loudspeaker includes a first end for being positioned in a first area of the vehicle that is exposed to external ambient noise to the vehicle and a second end for being positioned in a second area of the vehicle that is exposed directly within an interior cabin of the vehicle to provide desired audio along a first axis to the interior cabin. The carrier is attached to the second end of the loudspeaker and to the diaphragm and includes noise absorption material to prevent the external ambient noise from entering into the interior of the cabin along the first axis. The carrier defines a first opening to receive the noise absorption material. The carrier and the noise absorption material define at least one second opening to enable the desired audio to pass therethrough along the first axis into the interior of the cabin.

In at least another embodiment, a loudspeaker assembly for a vehicle is provided. The assembly includes a diaphragm; a loudspeaker, and a carrier. The loudspeaker includes a first end for being positioned in a first area of the vehicle that is exposed to external ambient noise to the vehicle and a second end for being positioned in a second area of the vehicle that is exposed directly within an interior cabin of the vehicle to provide desired audio along a first axis to the interior cabin. The carrier is attached to the second end of the loudspeaker and to the diaphragm and includes noise absorption material to prevent the external ambient noise from entering into the interior of the cabin along the first axis. The carrier includes a first holder that faces into the interior cabin to carry the first noise absorption material on an underside thereof. The carrier defines a first plurality of openings formed on the first holder to enable the desired audio to pass along the first axis into the interior cabin without obstruction from the first noise absorption material.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
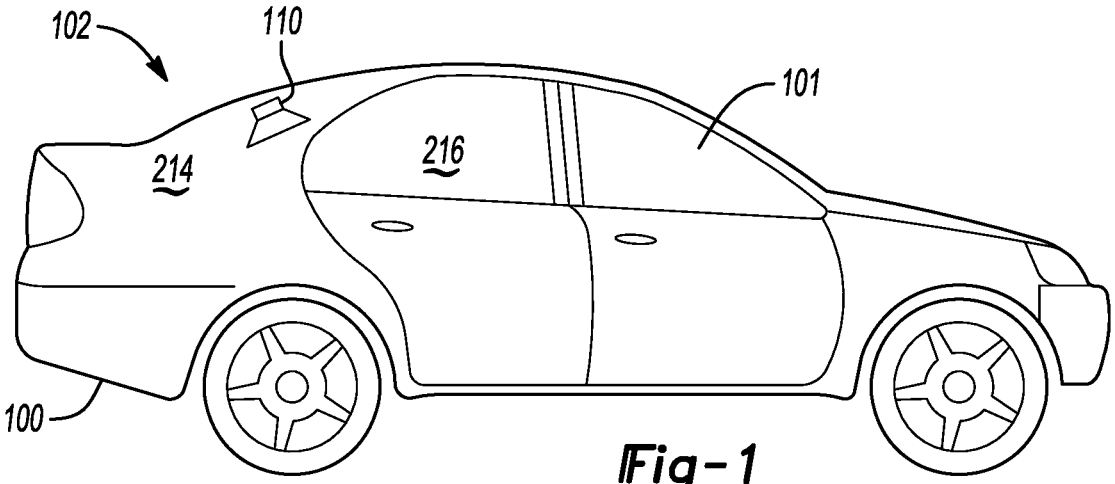
FIG. 1 depicts a vehicle including an externally coupled loudspeaker.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that directional terms that may be noted herein (e.g., "upper", "lower", "inner", "outer", "top", "bottom", etc.) simply refer to the orientation of various components of a busbar assembly as illustrated in the accompanying figures. Such terms are provided for context and understanding of the embodiments disclosed herein. Multiple embodiments are disclosed below and it is herein understood that similar reference numerals may be disclosed in connection with the different embodiments and that such reference numerals will not be described for every occurrence of these reference numerals in the embodiments for purposes of brevity.

Automotive sound systems typically include several loudspeakers positioned in various locations within the passenger compartment of a vehicle. Typical loudspeaker positions include door panels or interior trim panels. Low frequency reproducing loudspeakers, also known as woofers or subwoofers, are often located in the trunk, the rear panel shelf, the chassis or any frame elements of a vehicle. In this way an otherwise necessary loudspeaker housing may be omitted because the front and the back side of the loudspeaker are isolated from each other by the rear panel shelf or the chassis, respectively. Such a loudspeaker may be known as an externally coupled loudspeaker. This approach, therefore, allows for a very compact and weight efficient arrangement without sacrificing acoustical performance. Without a housing, however, the loudspeaker components have to sustain extreme environmental conditions, which makes it necessary to protect the loudspeaker, for example, by a weather resistant membrane. Further, noise that may normally be blocked by the otherwise sealed passenger cabin may enter externally into the vehicle through the externally coupled loudspeaker which leads to a higher noise pollution and causes concern for Noise Vibration Harshness (NVH) quality.

In general, embodiments disclosed herein provide for, but not limited to, a loudspeaker including a noise control device that may be comprised of at least two pieces. The first piece may be a noise control piece formed of a NVH material with either a rigid or soft absorptive material. The NVH material may reduce or absorb any external air born noise from outside of an installation (e.g. from ambient environment external to the vehicle). The specification for the NVH material generally depends on the amount of noise absorption that is desired. The second piece may be formed of, for example, a plastic carrier that holds or supports the NVH material but additionally creates a path for sound energy to propagate therefrom. Specifically, the desired sound energy may propagate from behind the carrier and into an interior listening environment for vehicle occupants. Such an arrangement may reduce externally generated noise that enters through the externally coupled shroud of the loudspeaker while also providing little to no adverse acoustic impact on the desired sound energy passed through the loudspeaker.

FIG. 1 depicts a vehicle 100 including an externally coupled loudspeaker 110. The loudspeaker 110 may be part of an automotive sound system. Automotive sound systems typically include several loudspeakers. Only one loudspeaker 110 is illustrated in FIG. 1 for illustrative purposes. The loudspeaker 110 may be positioned in different locations within a passenger compartment 101 of the vehicle 100. If the loudspeaker 110 is positioned in a chassis of the vehicle 100 between the passenger compartment 101 and an outside 102 of the vehicle 100, a loudspeaker housing may not be required for the loudspeaker 110. This, therefore, may provide a compact and weight efficient loudspeaker that does not sacrifice acoustical performance.

The loudspeaker 110 may be considered to be an externally coupled loudspeaker. For example, the loudspeaker 110 itself may be coupled of a portion of the vehicle 100 in which the loudspeaker 110 may enable ambient sound that is external to the vehicle 100 to pass into the passenger compartment 101 of the vehicle 100. One drawback that arises due to the direct coupling of the loudspeaker 110 to an outside 102 (or exterior environment) of the vehicle 100 may be instantaneous air pressure differences between the passenger compartment 101 and the exterior environment 102 of the vehicle, for example, when driving into a tunnel at high speed or when opening the sunroof at an elevated speed. This may impact the membrane rest position and/or displacement of the moving voice coil and thereby the overall performance of the loudspeaker 110. Further, as noted above, noise that may usually be blocked by the otherwise sealed passenger compartment may enter the passenger compartment (or cabin) 101 from the external environment 102 which may lead to a higher noise pollution.

Figure 2:
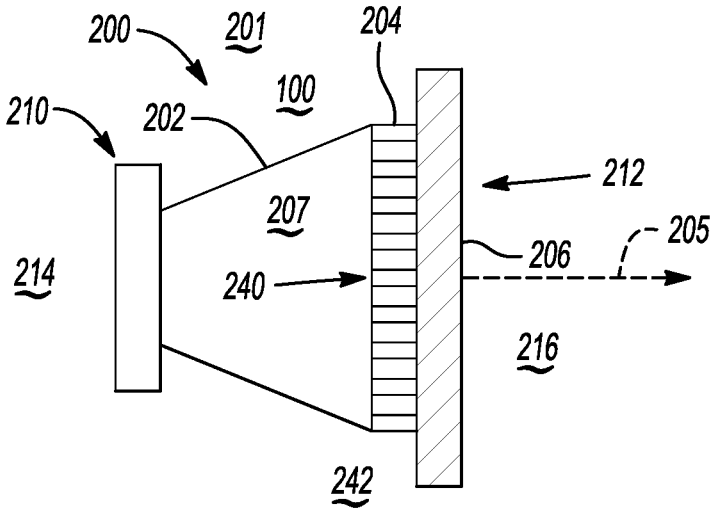
FIG. 2 depicts a first loudspeaker assembly in accordance to one embodiment.

FIG. 2 depicts a first loudspeaker assembly 200 in accordance to one embodiment. The first loudspeaker assembly 200 may be an externally coupled loudspeaker within the vehicle 100. The first loudspeaker assembly 200 may be a subwoofer (or woofer) may be configured to emit audio signals at a frequency of between 20-200 Hz. The assembly 200 generally includes loudspeaker 201, a cone (or diaphragm) 202, a ring (or carrier) 204, and noise absorption material 206. The diaphragm 202 may be formed of paper, paper composites/laminates, or plastic such as polypropylene or mineral/fiber filled polypropylene. The first loudspeaker assembly 200 may have a first end 210 positioned in a first area (or external area 214) that is exposed to external ambient noise to the vehicle 100 and a second end 212 that is positioned within a second area 216 (or interior area 216) of the vehicle 100 to provide audio to the interior cabin 216 along a first axis 205.

The noise absorption material 206 may be generally placed on a second end 212 of the first loudspeaker assembly 200 such that the noise absorption material 206 is positioned within the second area 216 of the vehicle 100 (or interior of the vehicle 100). The carrier 204 may be attached to the second end 212 of the first loudspeaker assembly 200 (or to the diaphragm 202). The noise absorption material 206 is generally configured to reduce or absorb ambient noise that travels from the first area of the vehicle 100 into the second area of the vehicle 100. The carrier 204 may include a plurality of openings 240 that are formed on a surface thereof. The plurality of openings 240 may be positioned within the interior area 216 and may enable desired audio signals to pass therethrough and around the noise absorption material 206 into the interior area 216. In one example, the plurality of openings 240 may take on any number of shapes. In the example illustrated in FIG. 2, the plurality of openings 240 are formed as slots. It is recognized that the first loudspeaker assembly 200 may be positioned on a baffle 242 or other panel in the vehicle 100. The baffle 242 may form a barrier between the external area 214 and the interior area 216 of the vehicle 100. Thus, the noise absorption material 206 and the plurality of openings 240 (e.g., the second end 212 of the first loudspeaker assembly 200) may be positioned on one side of the baffle 242 within the interior area 216.

In general, the plurality of openings 240 enable the desired audio to enter into the passenger compartment 101 along a second axis 207 that is different from the first axis 205 (i.e., the second axis 207 as illustrated in FIG. 2 generally extends from out of the page assuming the opening 204 as located closest to the first axis 205 is used as a reference point). In this instance, the second axis 207 may be generally perpendicular to an outer perimeter of the diaphragm 202 to enable the desired audio to enter into the interior cabin 216 at an angle that is generally perpendicular to the outer perimeter of the diaphragm 202. As shown, the plurality of openings 204 are radially formed on an outer periphery of the carrier 204 and each desired audio signal that projects from a corresponding opening 204 projects on an axis that is different that the first axis 205). The second axis 207 may be generally perpendicular to an outer perimeter of the diaphragm 202 to enable the desired audio to enter into the interior cabin 216 at an angle that is generally perpendicular to the outer perimeter of the diaphragm.

Figure 3:
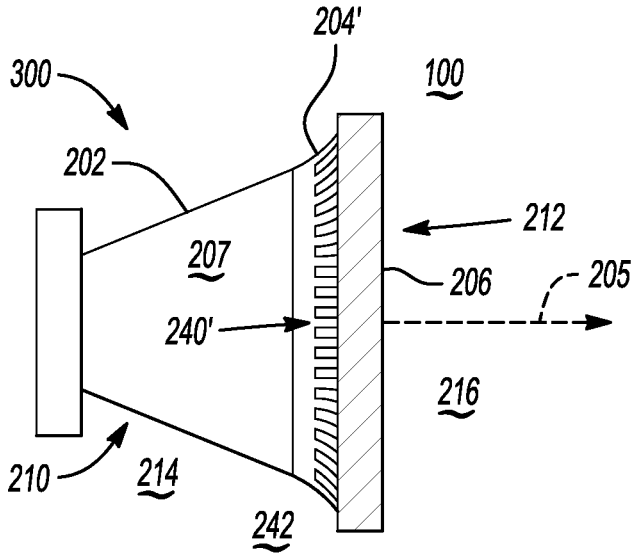
FIG. 3 depicts a second loudspeaker assembly in accordance to one embodiment.

FIG. 3 depicts a second loudspeaker assembly 300 in accordance to one embodiment. The second loudspeaker assembly 300 is generally similar to the first loudspeaker assembly 200. However, the second loudspeaker assembly 300 includes a carrier 204' that includes a radius that is formed on an outer surface thereof. The carrier 204' also defines a plurality of openings 240' that also take on the radius. The radius of the carrier 204' and the openings 240' provide a directional flow of audio energy at a predetermined angle to passengers within the interior area 216. As noted above, the plurality of openings 240' may generally enable the desired audio signals to pass therethrough and around the noise absorption material 206 into the interior area 216. The radius of the carrier 204' may enable the openings 240' to provide additional open surface area when compared to a straight wall implementation having the plurality of openings 204 as set forth in FIG. 1. The second loudspeaker assembly 300 includes the first end 210 positioned in the first area (or external area 214) that is exposed to external ambient noise to the vehicle 100 and the second end 212 that is positioned within the second area 216 (or interior area 216) of the vehicle 100 to provide audio to interior area 216 along the first axis 205.

In general, the plurality of openings 240' enable the desired audio to enter into the interior area 216 along the second axis 207 that is different from the first axis 205 (i.e., the second axis 207 as illustrated in FIG. 2 generally extends from out of the page assuming the opening 240' as located closest to the first axis 205 is used as a reference point). As shown, the plurality of openings 240' is radially formed on an outer periphery of the carrier 204 and each desired audio signal that projects from a corresponding opening 240' projects on an axis that is different that the first axis 205).

Figure 4:
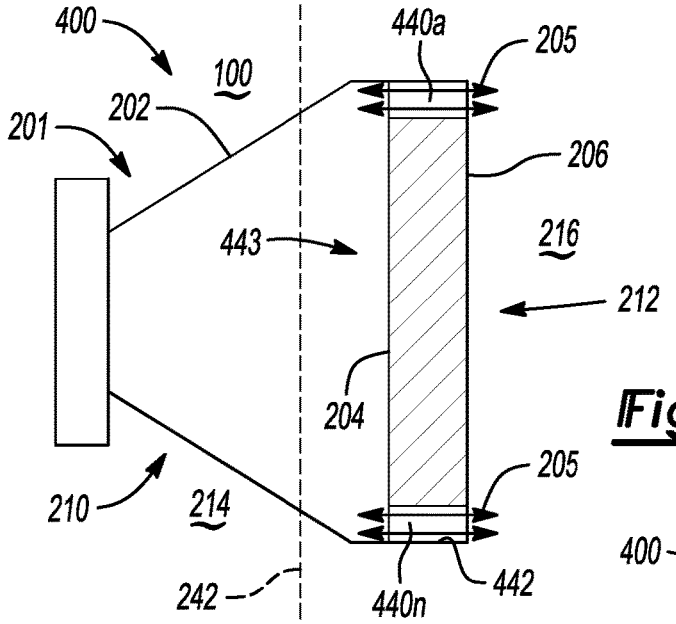
FIG. 4 depicts a third loudspeaker assembly in accordance to one embodiment.
Figure 5:
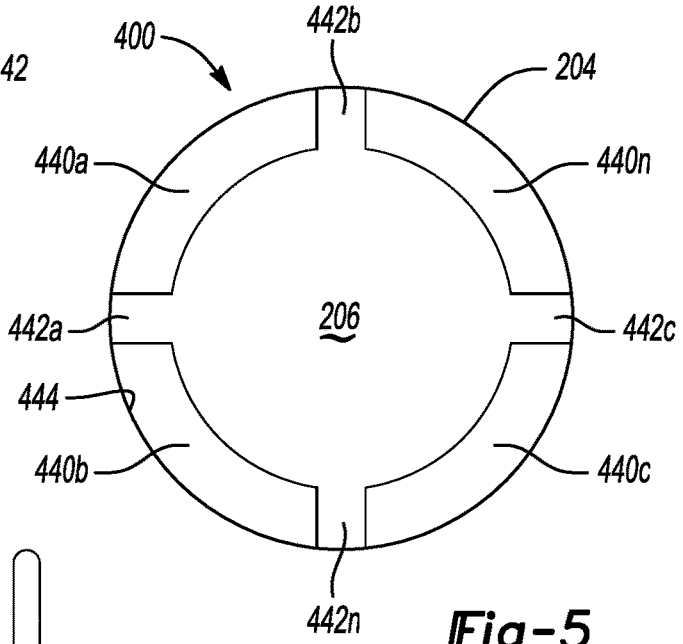
FIG. 5 depicts a top view of the third loudspeaker assembly.

FIG. 4 depicts a third loudspeaker assembly 400 in accordance to one embodiment. The third loudspeaker assembly 400 is generally similar to the first loudspeaker assembly 200. However, a plurality of openings 440*a*-440*n* is formed on an outer periphery to the carrier 204 (see FIG. 5 for reference in addition to FIG. 4). The plurality of openings 440*a*-440*n* may at least partially surround the noise absorption material 206. It is contemplated that one or more contacting portions 442*a*-442*n* of the noise absorption material 206 may be coupled to an inner edge 442 of the carrier 204 to fix the noise absorption material 206 to the carrier 204 (see FIG. 5). In this case, the openings 440*a*-440*n* enable the desired audio signals to pass therethrough the inner outer periphery of the carrier 204 and over an outer edge of the noise absorption material 206. The openings 440*a*-440*n* in addition to the noise absorption material 204 are positioned on one side of the baffle 242 within the interior area 216. As similarly noted above, the noise absorption material 206 is generally configured to reduce or absorb ambient noise that travels from the exterior area 214 of the vehicle 100 into the interior area 216 of the vehicle 100. The carrier 204 defines a first opening 443 to receive the noise absorption material 206. The carrier 204 and the noise absorption material 206 define the openings 440*a*-440*n* to enable the desired audio to pass therethrough along the first axis 205 into the interior cabin 216.

Figure 6:
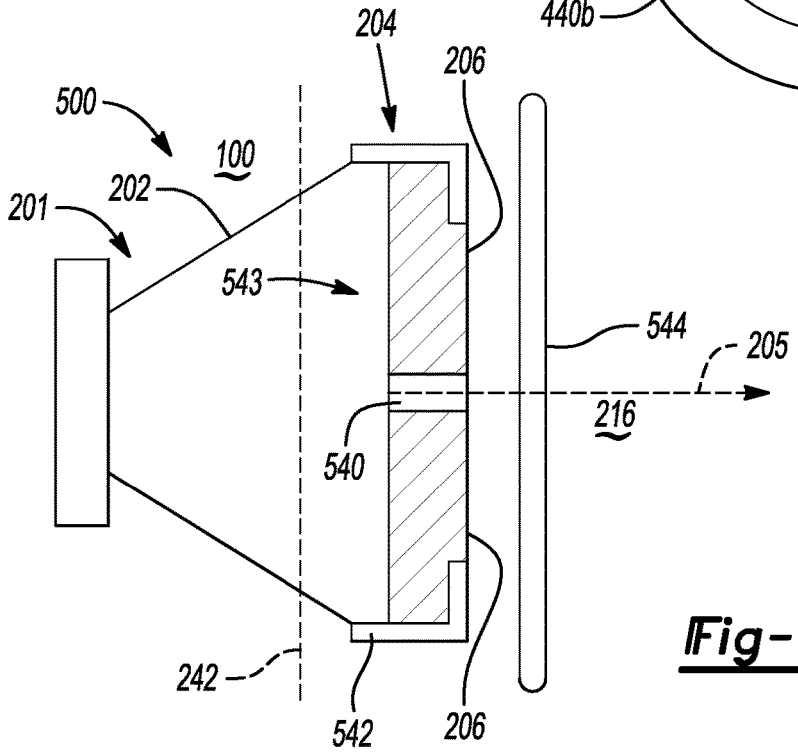
FIG. 6 depicts a fourth loudspeaker assembly in accordance to one embodiment.

FIG. 6 depicts a fourth loudspeaker assembly 500 in accordance to one embodiment. The fourth loudspeaker assembly 500 may be generally similar to the first loudspeaker assembly 200. However, with the fourth loudspeaker assembly 500, the noise absorption material 206 generally defines an opening 540 therein to enable the desired audio signal to pass therethrough and into the interior area 216. Similarly, to that noted above, the noise absorption material 206 is generally configured to reduce or absorb ambient noise that travels from the exterior area 214 of the vehicle 100 into the interior area 216 of the vehicle 100. The carrier 204 includes a holder 542 formed on an outer perimeter thereof to receive the noise absorption material 206. The noise absorption material 206 may be fixed to the holder 542 via, for example, an adhesive. The holder 542 may be generally L-shaped and may be plastic or other suitable material. The particular shape of the holder 542 may vary based on the desired criteria of a particular implementation. A loudspeaker grille 544 may be positioned in front of the noise absorption material 206. The loudspeaker grille 544 may reflect any noise back into the noise absorption material 206 while allowing for an airflow gap of low frequency audio into the vehicle interior area 216. The carrier 204 defines a first opening 543 to receive the noise absorption material 206. The carrier 204 and the noise absorption material 206 define the opening 540 to enable the desired audio to pass therethrough along the first axis 205 into the interior cabin 216.

Figure 7A:
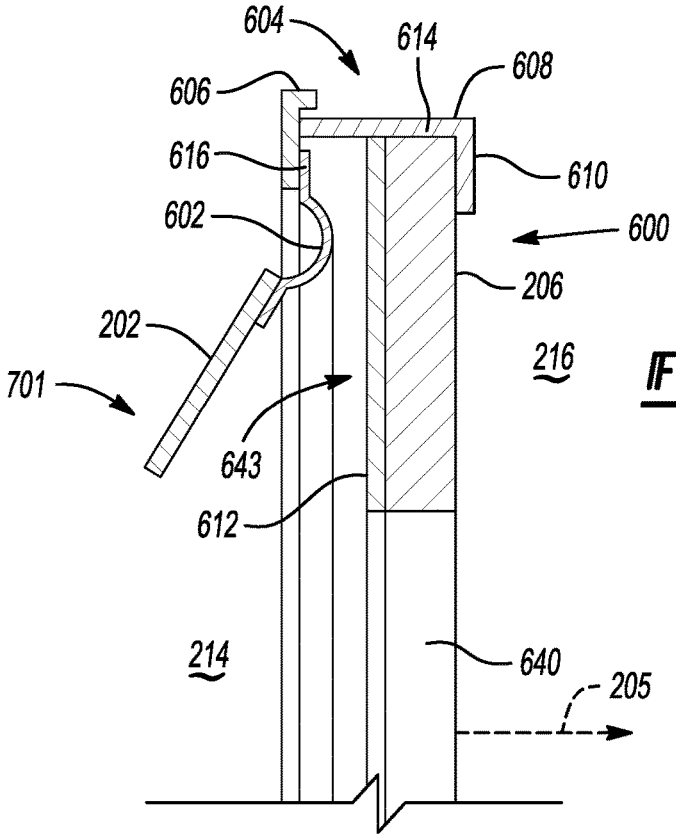
FIGS. 7A-7C depict various views of a fifth loudspeaker assembly in accordance to one embodiment.
Figure 7B:
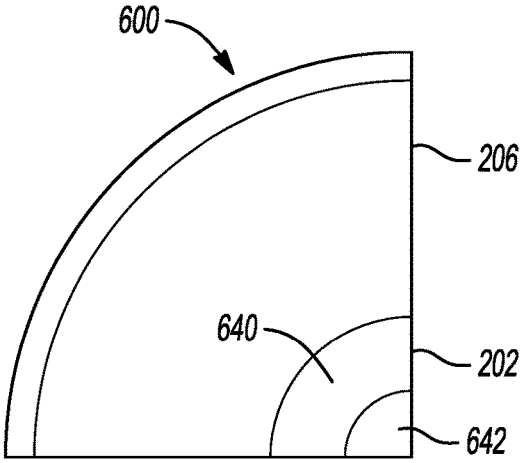
Figure 7C:
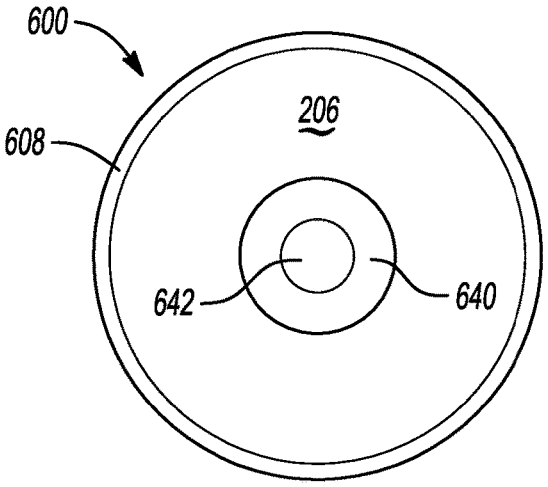

FIGS. 7A-7C depict various views of a fifth loudspeaker assembly 600 in accordance to one embodiment. FIG. 7A generally depicts a partial cross-sectional view of the fifth loudspeaker assembly 600. The fifth loudspeaker assembly 600 includes a carrier 604 that is configured to retain the noise absorption material 206. The carrier 604 may be formed of plastic or other suitable material. The carrier 604 includes a holder 608 for receiving and retaining the noise absorption material 206.

The holder 608 generally includes a first retaining portion 610 and a second retaining portion 612. A base section 614 is formed between the first retaining portion 610 and the second retaining portion 612. The base section 614, the first retaining portion 610 and the second retaining portion 612 are generally arranged to receive and retain the noise absorption material 206. As shown, the first retaining portion 610 and the second retaining portion 612 are parallelly spaced apart from one another. FIG. 7A generally illustrates that the first retaining portion 610 extends inwardly at a length that that is greater than that of the second retaining portion 612. It is recognized that the length of the first retaining portion 610 and the second retaining portion 612 may vary based on the desired criteria of a particular implementation.

The noise absorption material 206 generally defines an opening 640 located at a center point thereof to enable the desired audio signal to pass therethrough and into the interior area 216. This aspect is generally shown in FIG. 7C. Similarly, to that noted above, the noise absorption material 206 is generally configured to reduce or absorb ambient noise that travels from the exterior area 214 of the vehicle 100 into the interior area 216 of the vehicle 100. While not shown in the other FIGURES but still present, FIGS. 7B and 7C generally depict a dust cap 642 that is positioned behind the opening 640. Referring back to FIG. 8A, the carrier 604 also includes a landing 606 that is coupled to the base section 614. As shown the base section 614 generally extends on both sides of the second retaining portion 612. The landing 606 is coupled to the base section 614 and includes a receiving portion 616. The cone 202 includes a surround 602 that is attached to the receiving portion 616 via an adhesive or other suitable material. The surround 602 generally enables the cone 202 to travel bi-directionally along a center axis formed within a center of the opening 640 as the fifth loudspeaker assembly 600 generates audio. The carrier 604 defines a first opening 643 to receive the noise absorption material 206. The carrier 204 (i.e., the second retaining portion 612) and the noise absorption material 206 define the opening 640 to enable the desired audio to pass therethrough along the first axis 205 into the interior cabin 216.

Figure 8A:
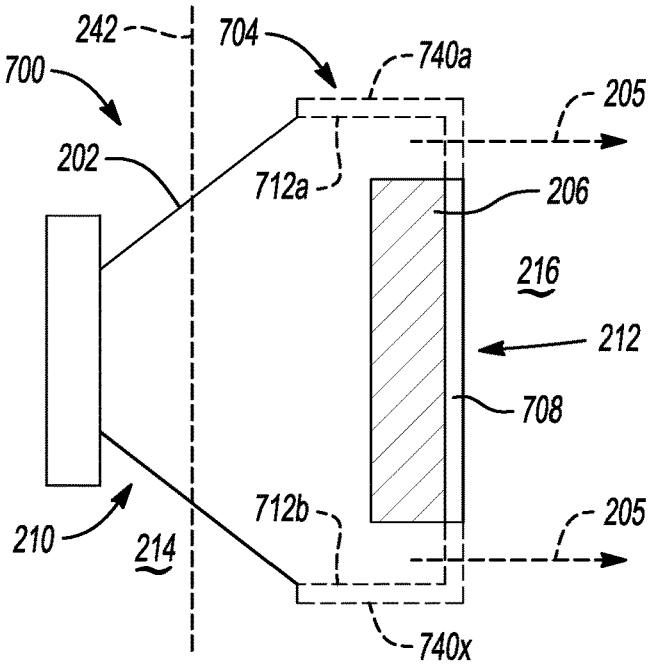
FIG. 8A-8B depict various views of a sixth loudspeaker assembly in accordance to one embodiment.
Figure 8B:
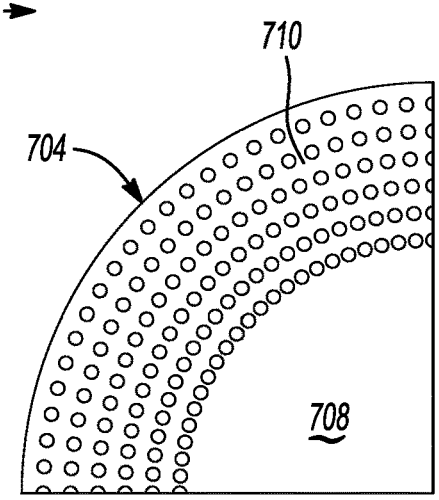

FIGS. 8A-8B depict various views of a sixth loudspeaker assembly 700 in accordance to one embodiment. FIG. 8A generally depicts a partial cross-sectional view of the seventh loudspeaker assembly 700. The seventh loudspeaker assembly 700 includes a carrier 704 that is configured to retain the noise absorption material 206. As noted above, the carrier 704 may be formed of plastic or other suitable material. The carrier 704 includes a holder 708 for receiving and retaining the noise absorption material 206. The carrier 804 also includes a region 710 that surrounds the holder 708 (see also FIG. 8B). The region 710 includes a plurality of openings 740*a*-740*x* (or "740") formed therein to enable the desired audio signal to pass therethrough and into the interior area 216. Similarly, to that noted above, the noise absorption material 206 is generally configured to reduce or absorb ambient noise that travels from the exterior area 214 of the vehicle 100 into the interior area 216 of the vehicle 100. The diaphragm 202 may be fixed to ends 712*a* and 712*b* of the carrier 704 via adhesive or other suitable mechanism. The overall length of the noise absorption material 206 may vary based on the desired criteria of a particular implementation.

Figure 9:
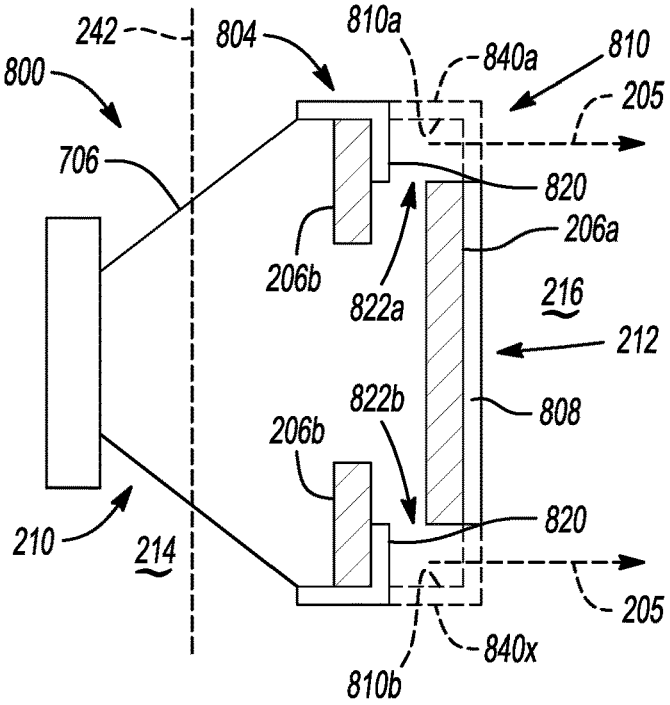
FIG. 9 depicts a seventh loudspeaker assembly in accordance to one embodiment.

FIG. 9 depicts a cross-sectional view of a seventh loudspeaker assembly 800 in accordance to one embodiment. The seventh loudspeaker assembly 800 includes a carrier 804 that is configured to retain the noise absorption material 206*a*-206*b*. As noted above, the carrier 804 may be formed of plastic or other suitable material. The carrier 804 includes a first holder 808 for receiving and retaining the noise absorption material 206*a*. The first holder 808 generally faces into the into the interior cabin 216. The carrier 804 also includes a region 810 that surrounds the first holder 808. The region 810 includes a plurality of openings 840*a*-840*x* (or "840") formed therein to enable the desired audio signal to pass therethrough and into the interior area 216 without obstruction from the noise absorption material 206*a*. Similarly, to that noted above, the noise absorption material 206*a* is generally configured to reduce or absorb ambient noise that travels from the exterior area 214 of the vehicle 100 into the interior area 216 of the vehicle 100. The first holder 808 carries the noise absorption material 206*a* on an underside thereof.

The carrier 804 may include a second holder 820 that retains the noise absorption material 206*b*. The diaphragm 202 may be fixed to ends 812*a* and 812*b* of the second holder 820 via adhesive or other suitable mechanism. As shown, the noise absorption material 206*a* and 206*b* are generally spaced apart and parallel to one another. The noise absorption material 206*a* and 206*b* define a first audio channel 822*a* and a second audio channel 822*b* to enable audio generated from the seventh loudspeaker assembly 800 to pass through the openings 840*a*-840*x* and into the interior cabin 216 of the vehicle along the first axis 205. The overall length of the noise absorption material 206*a* and 206*b* may vary based on the desired criteria of a particular implementation.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker assembly for a vehicle comprising:

a diaphragm;

a loudspeaker including a first end for being positioned in a first area of the vehicle that is exposed to external ambient noise to the vehicle and a second end for being positioned in a second area of the vehicle that is exposed directly within an interior cabin of the vehicle to provide desired audio along a first axis to the interior cabin;

a carrier being attached to the second end of the loudspeaker and to the diaphragm; and a noise absorption material to prevent the external ambient noise from entering into the interior of the cabin along the first axis, wherein the carrier defines a plurality of openings positioned on an outer perimeter thereof to enable the desired audio to enter into the interior cabin along a second axis that is different than the first axis, and wherein the noise absorption material is positioned directly adjacent to the carrier and the plurality of openings.

2. The loudspeaker assembly of claim 1, wherein the second axis is generally perpendicular to the first axis.

3. The loudspeaker assembly of claim 1, wherein the plurality of openings is formed of a plurality of slots.

4. The loudspeaker assembly of claim 1, wherein the second axis is generally perpendicular to an outer perimeter of the diaphragm to enable the desired audio to enter into the interior cabin at an angle that is generally perpendicular to the outer perimeter of the diaphragm.

5. The loudspeaker assembly of claim 1, wherein carrier is formed of plastic.

6. The loudspeaker assembly of claim 1, wherein the diaphragm is formed of paper, paper composites, polypropylene or mineral/fiber filled polypropylene.

7. A loudspeaker assembly for a vehicle comprising:

a diaphragm;

a loudspeaker including a first end for being positioned in a first area of the vehicle that is exposed to external ambient noise to the vehicle and a second end for being positioned in a second area of the vehicle that is exposed directly within an interior cabin of the vehicle to provide desired audio along a first axis to the interior cabin; and a carrier being attached to the second end of the loudspeaker and to the diaphragm and including noise absorption material to prevent the external ambient noise from entering into the interior of the cabin along the first axis, wherein the carrier defines a first opening to receive the noise absorption material;

wherein the carrier and the noise absorption material define at least one second opening; and wherein the at least one second opening extends completely through the noise absorption material to enable the desired audio to pass therethrough along the first axis into the interior of the cabin.

8. The loudspeaker assembly of claim 7, wherein the at least one second opening is formed on an outer perimeter of the noise absorption material.

9. The loudspeaker assembly of claim 7, wherein the at least one second opening is formed in a center of the noise absorption material.

10. The loudspeaker assembly of claim 7, wherein the carrier includes a first retaining portion to directly receive the noise absorption material.

11. The loudspeaker assembly of claim 10, wherein the carrier includes a second retaining portion positioned directly below the first retaining portion to receive the diaphragm.

12. The loudspeaker assembly of claim 11, wherein the second retaining portion includes a landing to receive a surround of the diaphragm to fix the carrier to the diaphragm.

13. The loudspeaker assembly of claim 12, wherein at least a portion of the noise absorption material is positioned directly above the surround.

14. A loudspeaker assembly for a vehicle comprising:

a diaphragm;

a loudspeaker including a first end for being positioned in a first area of the vehicle that is exposed to external ambient noise to the vehicle and a second end for being positioned in a second area of the vehicle that is exposed directly within an interior cabin of the vehicle to provide desired audio along a first axis to the interior cabin; and a carrier being attached to the second end of the loudspeaker and to the diaphragm and including first noise absorption material to prevent the external ambient noise from entering into the interior of the cabin along the first axis, wherein the carrier includes a first holder that faces into the interior cabin to carry the first noise absorption material on an underside thereof, and wherein the carrier defines a first plurality of openings formed on a first side of the first holder to enable the desired audio to pass along the first axis into the interior cabin without obstruction from the first noise absorption material.

15. The loudspeaker assembly of claim 14, wherein the first plurality of openings is formed on an outer perimeter of the first holder of the carrier.

16. The loudspeaker assembly of claim 15, wherein the first plurality of openings surround the first noise absorption material.

17. The loudspeaker assembly of claim 14, wherein the carrier includes a second side that is generally perpendicular to the first side.

18. The loudspeaker assembly of claim 17, wherein the second side includes a second plurality of openings for enabling the desired audio to enter into the interior cabin of the vehicle along a second axis.

19. The loudspeaker assembly of claim 14, wherein the carrier includes a second holder to carry a second noise absorption material.

20. The loudspeaker assembly of claim 19, wherein the first noise absorption material and the second noise absorption material define a first audio channel and a second audio channel to enable the desired audio to pass through the first audio channel and the second audio channel and through the first plurality of opening along the first axis and into the interior cabin of the vehicle.

* * * * *